US011529642B2

(12) United States Patent
Shi et al.

(10) Patent No.: US 11,529,642 B2
(45) Date of Patent: Dec. 20, 2022

(54) SINGLE-BUTTON WATER PASSAGE SWITCHING STRUCTURE

(71) Applicant: Purity (Xiamen) Sanitary Ware Co., Ltd., Fujian (CN)

(72) Inventors: Longyun Shi, Xiamen (CN); Shifa Huang, Xiamen (CN); Guozhong Wu, Xiamen (CN); Xiwen Yang, Xiamen (CN); Weisheng Wu, Xiamen (CN); Jinlong Wu, Xiamen (CN)

(73) Assignee: PURITY (XIAMEN) SANITARY WARE CO., LTD., Fujian (CN)

( * ) Notice: Subject to any disclaimer, the term of this patent is extended or adjusted under 35 U.S.C. 154(b) by 239 days.

(21) Appl. No.: 16/924,219

(22) Filed: Jul. 9, 2020

(65) Prior Publication Data

US 2021/0008580 A1 Jan. 14, 2021

(30) Foreign Application Priority Data

Jul. 12, 2019 (CN) ..... 201910629950.3

(51) Int. Cl.

| | |
|---|---|
| ***B05B 12/00*** | (2018.01) |
| ***B05B 1/16*** | (2006.01) |
| ***B05B 1/18*** | (2006.01) |
| ***E03C 1/04*** | (2006.01) |

(52) U.S. Cl.

CPC ..... *B05B 12/002* (2013.01); *B05B 1/1663* (2013.01); *B05B 1/18* (2013.01); *E03C 1/0405* (2013.01)

(58) Field of Classification Search

CPC ..... B05B 12/002; B05B 1/1663; B05B 1/18; B05B 1/1681; B05B 1/169; B05B 7/0425; E03C 1/0405

See application file for complete search history.

(56) References Cited

U.S. PATENT DOCUMENTS

2007/0221757 A1* 9/2007 Malek ..... B05B 12/002 239/447

* cited by examiner

*Primary Examiner* — Qingzhang Zhou

(74) *Attorney, Agent, or Firm* — Leong C. Lei

(57) ABSTRACT

A single-button water passage switching structure includes a water inlet assembly and a water outlet assembly. The water inlet assembly includes a water inlet body, an operating button, a first control assembly, and a second control assembly. The water inlet body has a first mounting chamber and a second mounting chamber. The first mounting chamber and the second mounting chamber each have a water inlet and two water outlets. The first control assembly is configured to realize a pause mode, a first spray mode or the switching of water passages of the second mounting chamber. The second control assembly is configured to realize the switching of water passages of a second spray mode or a third spray mode. The operating button is configured to link the first control assembly and the second control assembly.

9 Claims, 10 Drawing Sheets

SINGLE-BUTTON WATER PASSAGE SWITCHING STRUCTURE

BACKGROUND OF THE INVENTION

1. Field of the Invention

The present invention relates to a shower head, and more particularly, to a single-button water passage switching structure.

2. Description of the Prior Art

A conventional shower head provides various spray modes, such as a shower spray mode, an aerated spray mode, a strong spray mode, etc., meeting different needs of the user. In general, the conventional shower head controls two spray modes through buttons. With the progress of the society and the improvement of the living standard, users desire the shower head to provide more and more functions. It is difficult for a shower head with two spray modes to meet the user's needs. For a shower head to realize more spray modes, it is necessary to set more water passages in the shower head, which leads to more control structures for switching the water passages of different spray modes. The product structure becomes complicated, the product is relatively large in size, and the production cost increases.

SUMMARY OF THE INVENTION

The primary object of the present invention is to provide a single-button water passage switching structure, which can realize the switching of multiple functions of the shower head through a single button, so as to meet the needs of various spray modes. The structure is compact to reduce the size and cost of products.

In order to achieve the above object, the present invention adopts the following technical solutions:

A single-button water passage switching structure comprises a water inlet assembly and a water outlet assembly. A water outlet end of the water inlet assembly is in communication with a water inlet end of the water outlet assembly. The water inlet assembly includes a water inlet body, an operating button, a first control assembly, and a second control assembly. A surface of the water inlet body is recessed with a first mounting chamber and a second mounting chamber. Extending directions of the first mounting chamber and the second mounting chamber are parallel to each other. The first mounting chamber and the second mounting chamber have openings arranged in a same direction. The first control assembly is fitted in the first mounting chamber. The second control assembly is fitted in the second mounting chamber. A water inlet end of the water inlet body has a water inlet passage. A water outlet end of the water inlet body has a first water outlet passage, a second water outlet passage, and a third water outlet passage. The first mounting chamber has a first water inlet, a first water outlet, and a second water outlet. The first water outlet, the first water inlet and the second water outlet are sequentially disposed on an inner wall of the first mounting chamber along an axial direction of the first mounting chamber. The second water outlet is disposed at a bottom of the first mounting chamber. The first water inlet communicates with the water inlet passage. The first water outlet communicates with the first water outlet passage. The second mounting chamber has a second water inlet, a third water outlet, and a fourth water outlet. The third water outlet, the second water inlet and the fourth water outlet are sequentially disposed on an inner wall of the second mounting chamber along an axial direction of the second mounting chamber. The fourth water outlet is disposed at a bottom of the second mounting chamber. The second water inlet communicates with the second water outlet. The third water outlet communicates with the second water outlet passage. The fourth water outlet communicates with the third water outlet passage. A middle portion of the operating button is pivotally connected to the water inlet body between the openings of the first mounting chamber and the second mounting chamber.

The first control assembly includes a first retaining member, a first connecting rod, and a sealing member. The first retaining member is hermetically fitted between the opening of the first mounting chamber and the first water inlet and blocks the first water outlet. The first retaining member has a first cavity with an opening facing the second water outlet. A bottom of the first cavity is provided with a first through hole extending along the axial direction of the first mounting chamber. A side wall of the first through hole is provided with a fifth water outlet communicating with the first water outlet. A middle portion of the first connecting rod is provided with a first sealing portion. The first connecting rod is movably inserted in the first through hole. The first sealing portion is movable to block the fifth water outlet. One end of the first connecting rod is hinged to a first end of the operating button. A first return spring is provided between the first end of the operating button and the first retaining member. The sealing member has a second cavity with an opening facing the first cavity. Another end of the first connecting rod is limited and fitted in the second cavity. A second return spring is provided between the bottom of the first cavity and the sealing member. The sealing member is movably, hermetically fitted to the opening of the first cavity or the second water outlet. In an assembled state, the sealing member is biased by the second return spring to block the second water outlet. Two ends of the first return spring lean against the first retaining member and the operating button to separate the first retaining member and the operating button. The first sealing portion is located on one side of the fifth water outlet close to the operating button.

The second control assembly includes a second retaining member and a second connecting rod. The second retaining member is hermetically fitted between the opening of the second mounting chamber and the second water inlet and blocks the third water outlet. The second retaining member has a third cavity with an opening facing the fourth water outlet. A side wall of the third cavity is provided with a sixth water outlet communicating with the third water outlet. A bottom of the third cavity is provided with a second through hole extending along the axial direction of the second mounting chamber. One end of the second connecting rod is movably, hermetically fitted in the first through hole and movably leans against a second end of the operating button. Another end of the second connecting rod is provided with a second sealing portion. A third return spring is provided between the second sealing portion and the bottom of the second mounting chamber. The second sealing portion is movably, hermetically fitted to the opening of the third cavity or the second sealing portion at the fourth water outlet. In the assembled state, the third return spring presses the second sealing portion to block the opening of the third cavity.

Preferably, a stroke distance of the second sealing portion between the opening of the third cavity and the fourth water outlet is not greater than a height of the second cavity.

Preferably, the water inlet body has a water-passing chamber. The water-passing chamber is located below the first mounting chamber and/or the second mounting chamber. The second water outlet and the second water inlet communicate with the water-passing chamber, respectively.

Preferably, the water inlet body includes a main body and a lower cover. The first mounting chamber and the second mounting chamber are disposed on the main body. The third water outlet passage and the water-passing chamber are disposed between the main body and the lower cover.

Preferably, a button cap is mounted on the operating button for easy operation.

Preferably, the other end of the first connecting rod is provided with a flange. The opening of the second cavity is provided with a limiting member. The other end of the first connecting rod is movably inserted through the limiting member and fitted in the second cavity. The flange is movably fitted to the limiting member to prevent the other end of the first connecting rod from coming out of the second cavity.

Preferably, a first sealing ring is sleeved on the sealing member, and the first sealing ring is movably, hermetically fitted to the opening of the first cavity or the second water outlet.

Preferably, a second sealing ring and a third sealing ring are sleeved on an outer periphery of the first sealing portion. The second sealing ring and the third sealing ring are movably, hermetically fitted in the first through hole. The third sealing ring is movable to block the fifth water outlet. The second sealing ring is located on the side of the fifth water outlet close to the operating button.

Preferably, a first O-ring and a second O-ring are sleeved on the first retaining member. The first O-ring and the second O-ring are hermetically fitted between an outer periphery of the first retaining member and the inner wall of the first mounting chamber. The first O-ring and the second O-ring are located at two sides of the first water outlet, respectively.

Preferably, the fourth water outlet is provided with a support frame. The second sealing portion is formed with a fourth cavity corresponding to the support frame. The third return spring is disposed between the fourth cavity and the support frame.

Preferably, a fourth sealing ring is sleeved on the outer periphery of the second sealing portion. The fourth sealing ring is movably, hermetically fitted to the opening of the third cavity or the fourth water outlet.

Preferably, a fifth sealing ring is sleeved on the middle of the second connecting rod. The fifth sealing ring is movably, hermetically between the second through hole and the sixth water outlet.

Preferably, a third O-ring and a fourth O-ring are sleeved on the second retaining member. The third O-ring and the fourth O-ring are hermetically fitted between the outer periphery of the second retaining member and the inner wall of the second mounting chamber. The third O-ring and the fourth O-ring are located at two sides of the third water outlet, respectively.

Preferably, the water outlet assembly has a first water outlet chamber, a second water outlet chamber and a third water outlet chamber corresponding to the first water outlet passage, the second water outlet passage, and the third water outlet passage, respectively. The first water outlet passage is in communication with the first water outlet chamber. The second water outlet passage is in communication with the second water outlet chamber. The third water outlet passage is in communication with the third water outlet chamber. The first water outlet chamber, the second water outlet chamber and the third water outlet chamber have different spray modes.

The single-button water passage switching structure further comprises a housing. The housing has an accommodating chamber therein. The water inlet assembly and the water outlet assembly are installed inside the accommodating chamber.

With the above structure, the present invention controls the two water outlets of the first mounting chamber through the first control assembly, and controls the two water outlets of the second mounting chamber through the second control assembly. The first control assembly is configured to realize the pause mode, the first spray mode or the switching of the water passages of the second mounting chamber. The second control assembly is configured to realize the switching of the water passages of the second spray mode or the third spray mode. The operating button is configured to link the first control assembly and the second control assembly, so as to realize the switching between four different spray modes through a single button. The present invention not only meets the needs of various spray modes, but also has a compact structure and fewer parts to reduce the size and cost of products.

DETAILED DESCRIPTION OF THE PREFERRED EMBODIMENTS

In order to explain the technical solution of the present invention, embodiments of the present invention will now be described, by way of example only, with reference to the accompanying drawings.

Referring to FIGS. 1 to 10, the present invention discloses a single-button water passage switching structure, comprising a housing 1, a water inlet assembly 2, and a water outlet assembly 3. The water inlet assembly 2 and the water outlet assembly 3 are installed inside the housing 1. A water outlet end of the water inlet assembly 2 is in communication with a water inlet end of the water outlet assembly 3. The water inlet assembly 2 has four functional modes, namely, a pause mode and three different spray modes. The water inlet assembly 2 can switch the four different functional modes with a single button.

Figure 1:
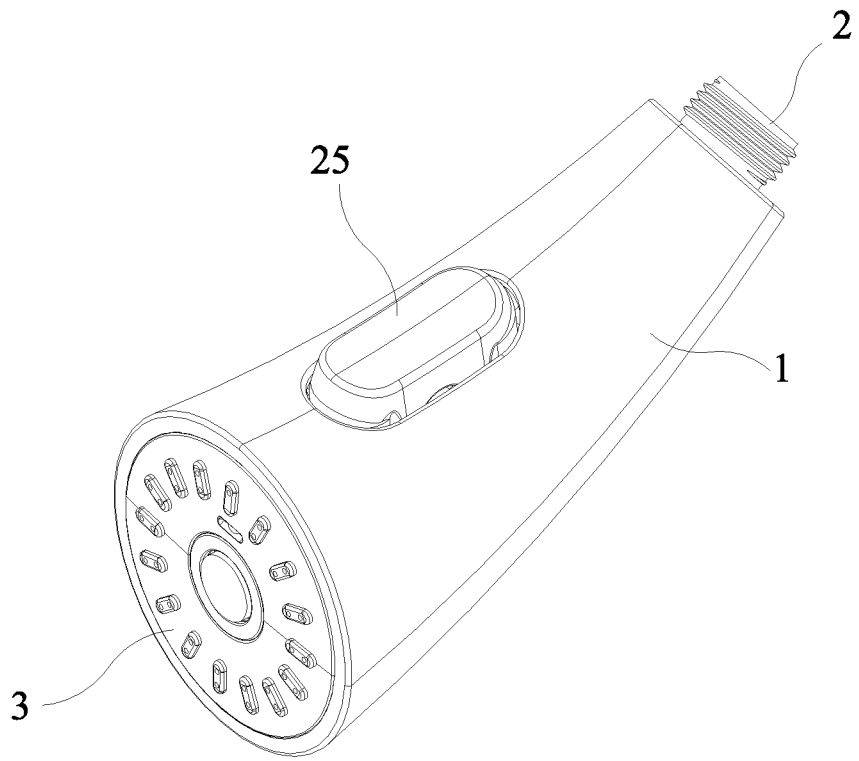
FIG. 1 is a perspective view in accordance with a preferred embodiment of the present invention.
Figure 2:
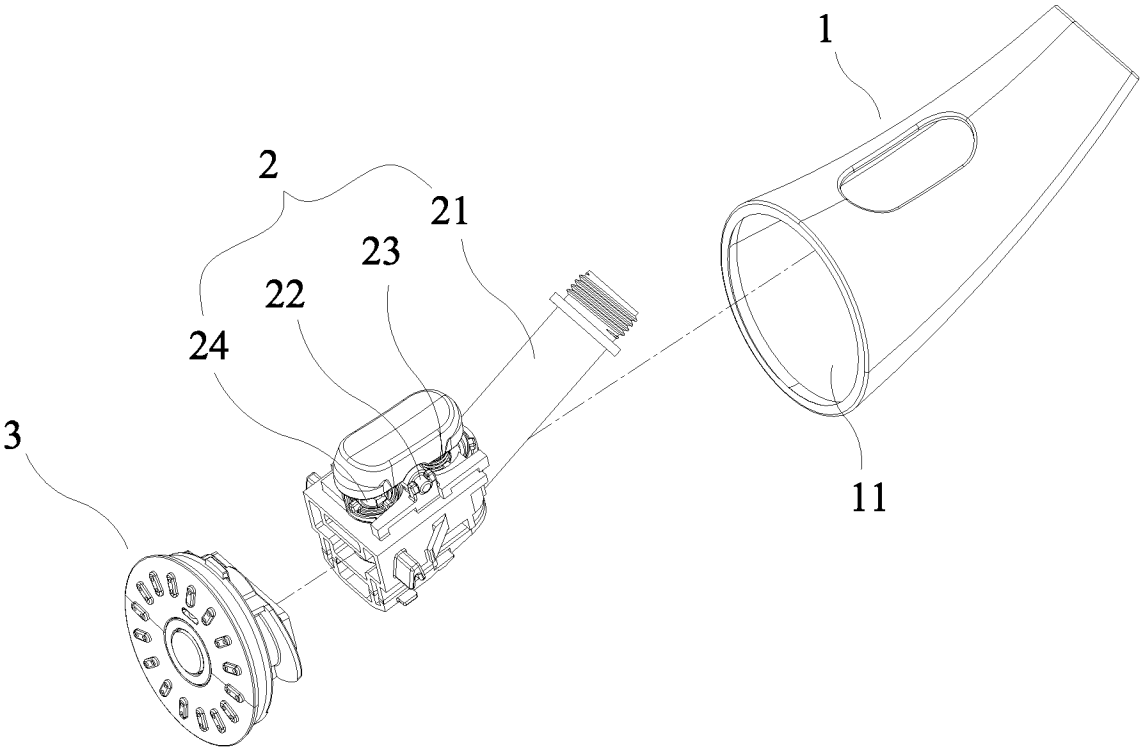
FIG. 2 is an exploded view in accordance with the preferred embodiment of the present invention.
Figure 3:
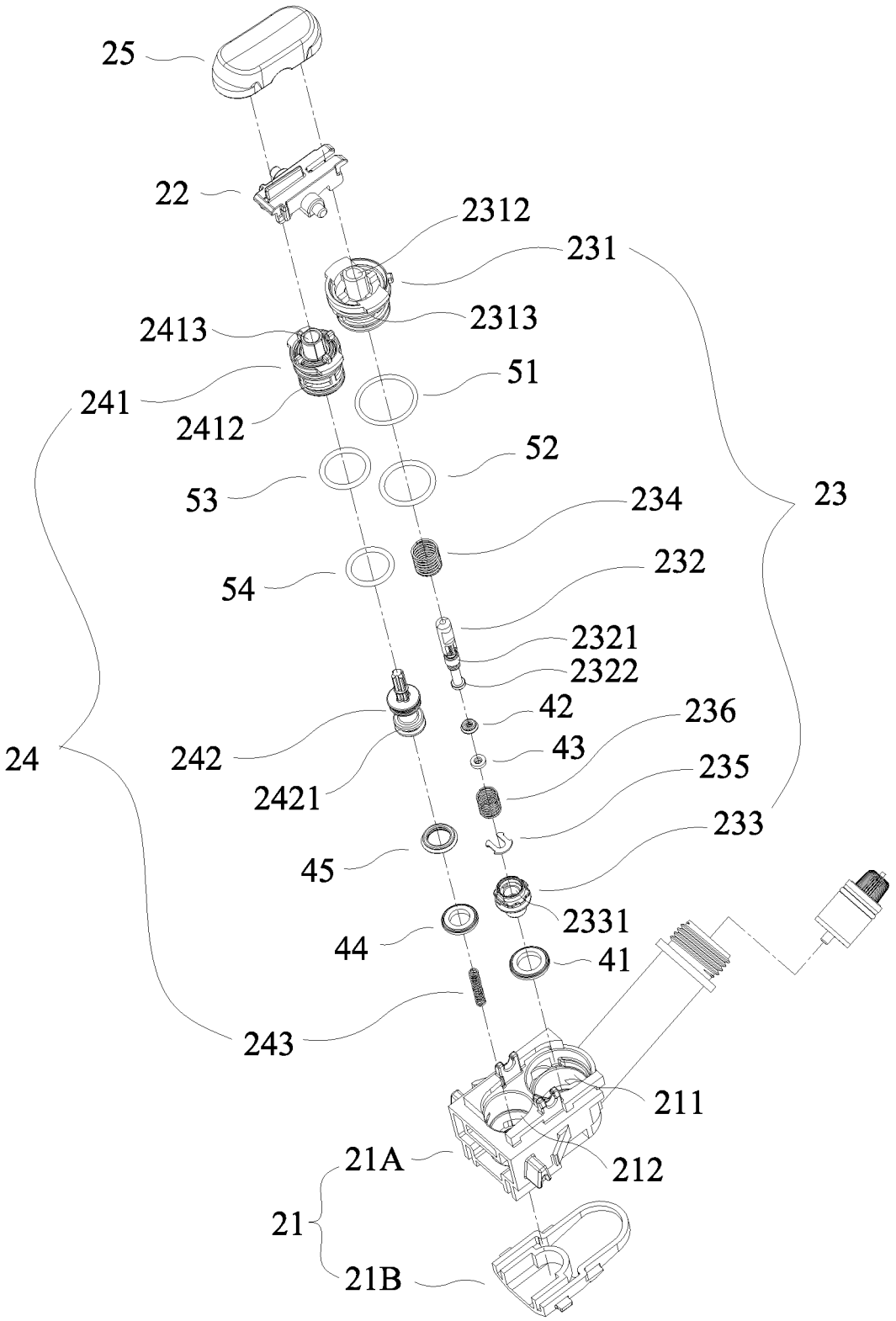
FIG. 3 is an exploded view of the water inlet assembly in accordance with the preferred embodiment of the present invention.
Figure 4:
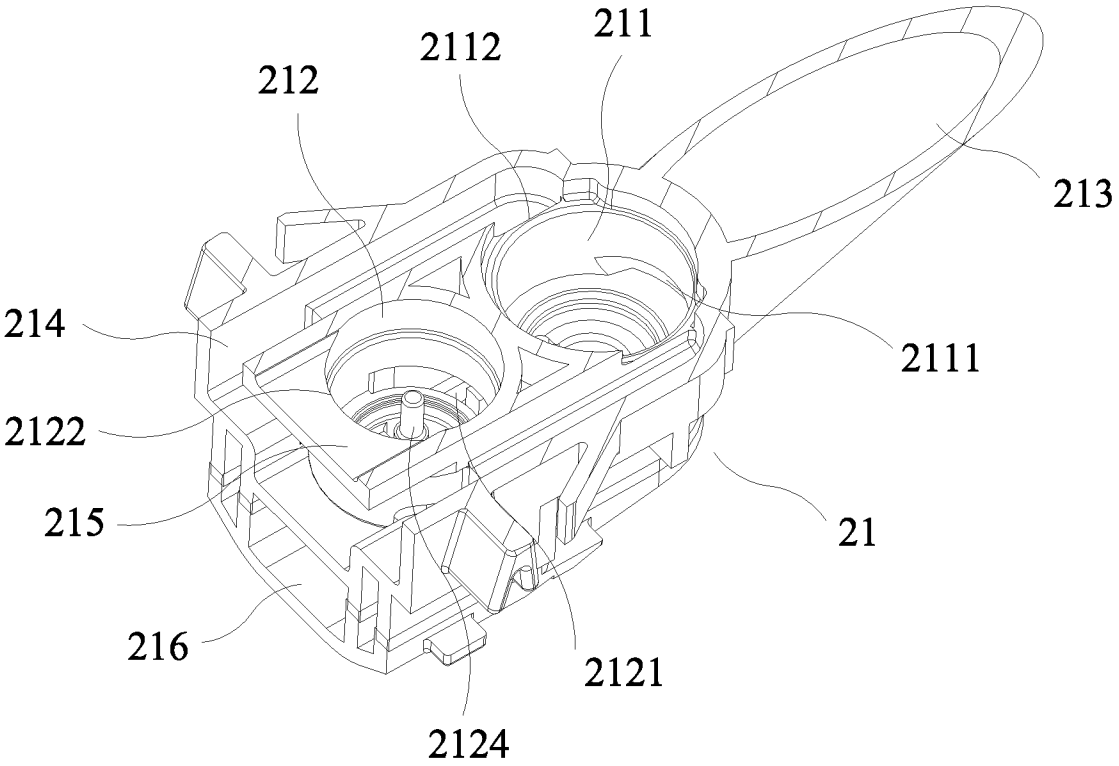
FIG. 4 is a transverse sectional view of the water inlet body in accordance with the preferred embodiment of the present invention.
Figure 5:
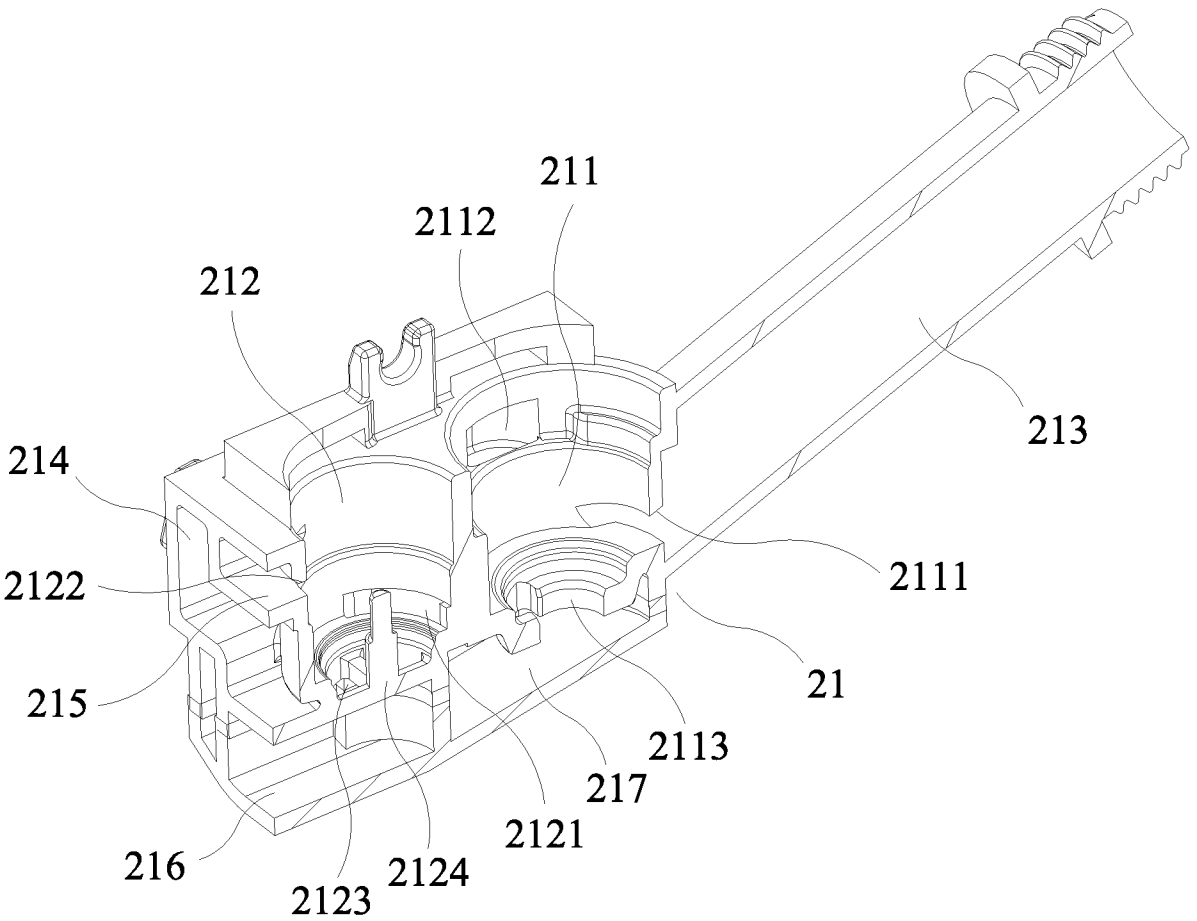
FIG. 5 is a vertical sectional view of the water inlet body in accordance with the preferred embodiment of the present invention.
Figure 6:
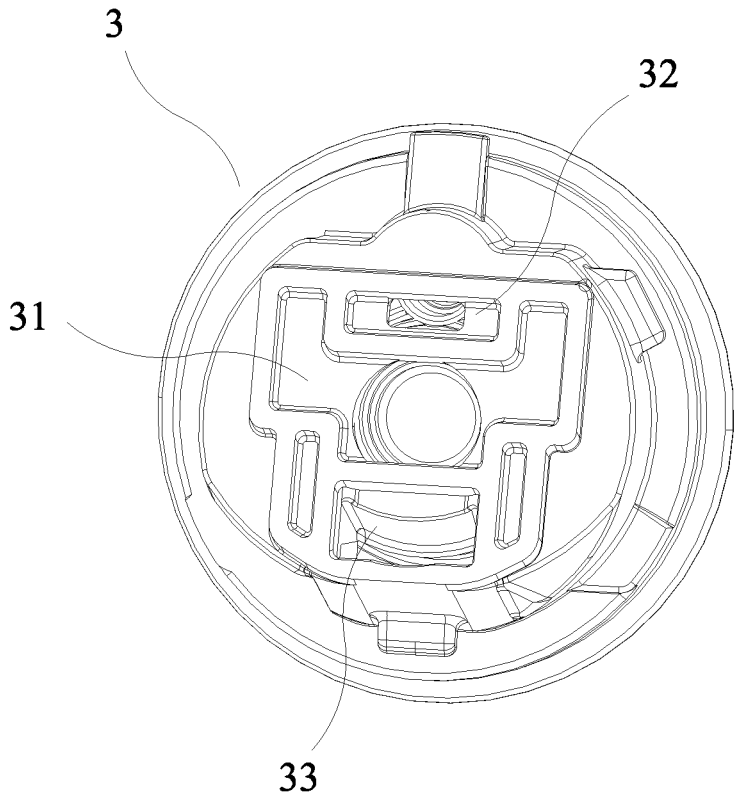
FIG. 6 is a perspective view of the water outlet assembly in accordance with the preferred embodiment of the present invention.
Figure 7:
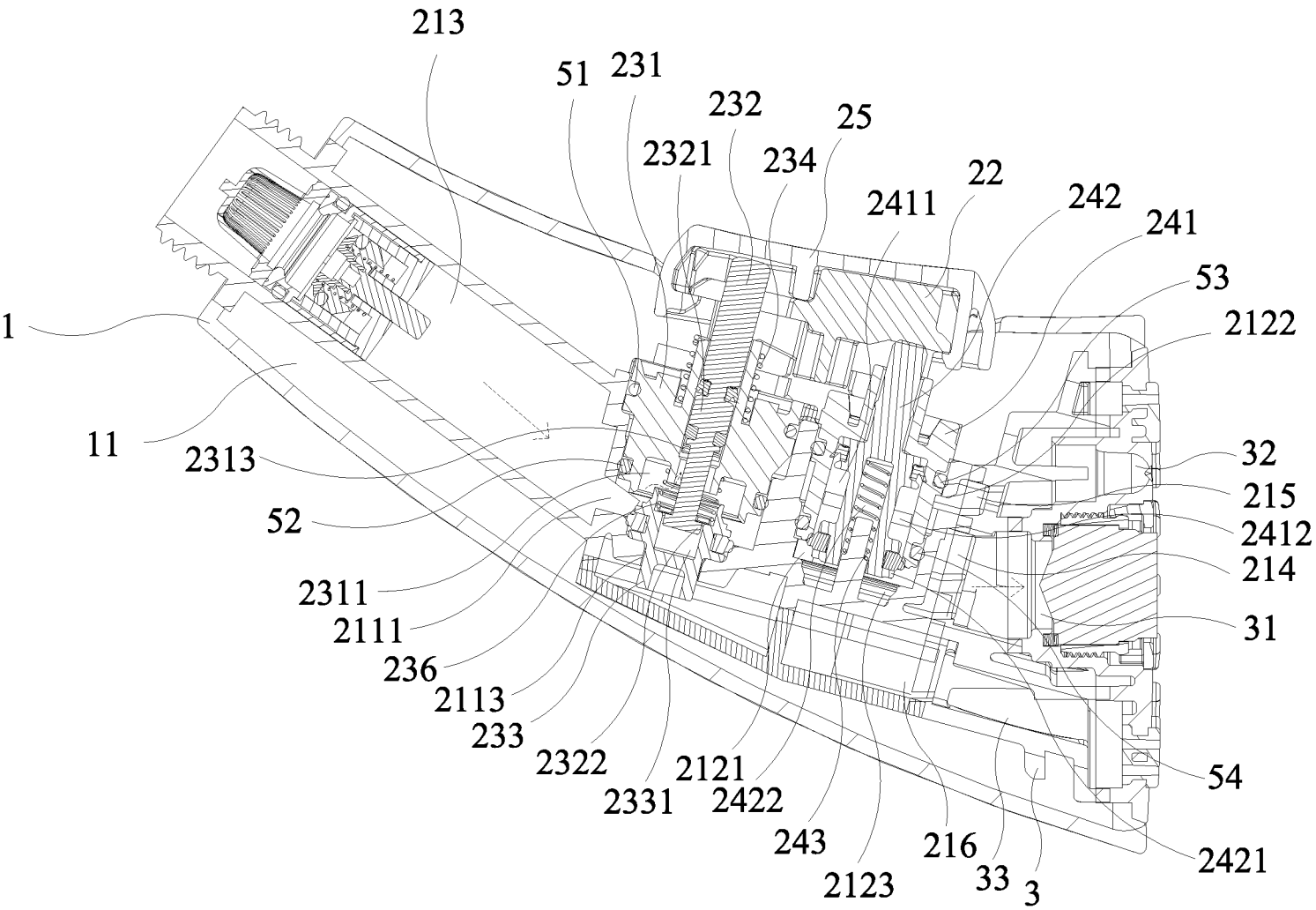
FIG. 7 is a schematic view in accordance with the preferred embodiment of the present invention, showing the water flow in the initial mode (the first spray mode)
Figure 8:
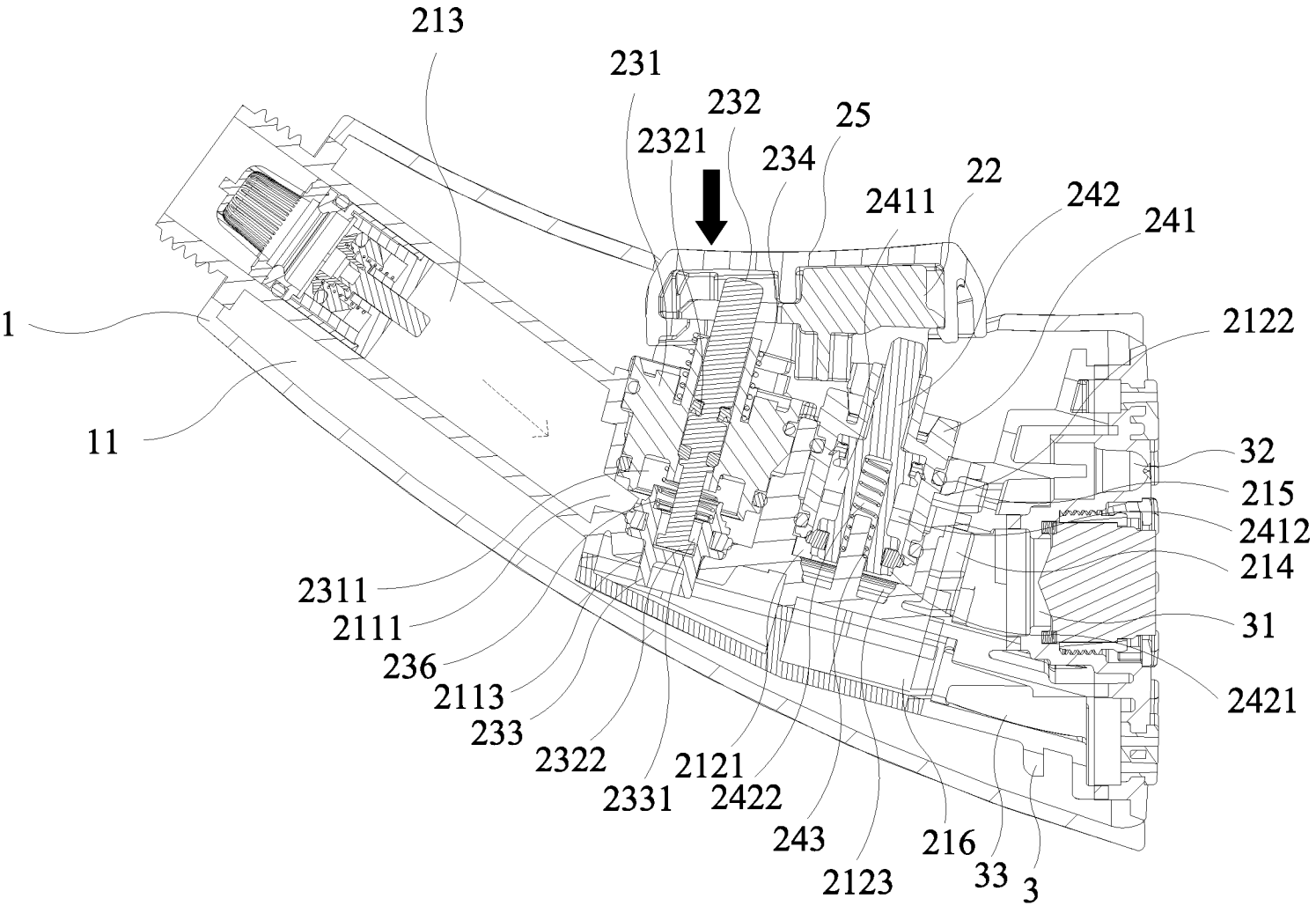
FIG. 8 is a schematic view in accordance with the preferred embodiment of the present invention, showing the water flow in the pause mode.
Figure 9:
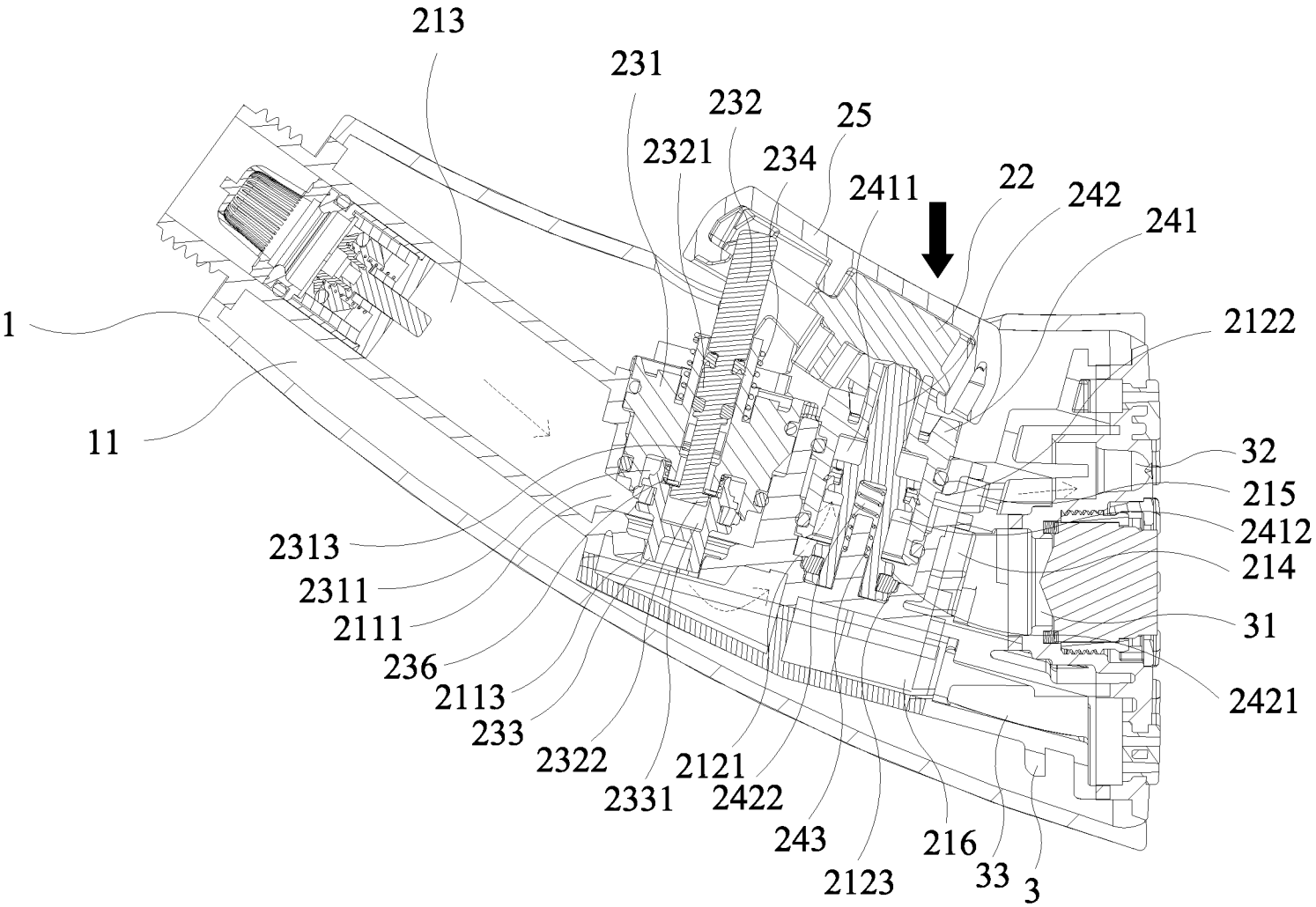
FIG. 9 is a schematic view in accordance with the preferred embodiment of the present invention, showing the water flow in the second spray mode.

Referring to FIG. 2, the housing 1 has an accommodating chamber 11 therein. Both the water inlet assembly 2 and the water outlet assembly 3 are installed in the accommodating chamber 11.

Referring to FIGS. 2 to 5, the water inlet assembly 2 includes a water inlet body 21, an operating button 22, a first control assembly 23, and a second control assembly 24. The surface of the water inlet body 21 is recessed with a first mounting chamber 211 and a second mounting chamber 212. The extending directions of the first mounting chamber 211 and the second mounting chamber 212 are parallel to each other. The openings of the first mounting chamber 211 and the second mounting chamber 212 are arranged in the same direction. The first control assembly 23 is fitted in the first mounting chamber 211, and the second control assembly 24 is fitted in the second mounting chamber 212.

A water inlet end of the water inlet body 21 has a water inlet passage 213. A water outlet end of the water inlet body 21 has a first water outlet passage 214, a second water outlet passage 215 and a third water outlet passage 216. The first mounting chamber 211 has a first water inlet 2111, a first water outlet 2112 and a second water outlet 2113. The first water outlet 2112, the first water inlet 2111 and the second water outlet 2113 are sequentially disposed on the inner wall of the first mounting chamber 211 along the axial direction of the first mounting chamber 211. The second water outlet 2113 is disposed at the bottom of the first mounting chamber 211. The first water inlet 2111 communicates with the water inlet passage 213. The first water outlet 2112 communicates with the first water outlet passage 214. The second mounting chamber 212 has a second water inlet 2121, a third water outlet 2122 and a fourth water outlet 2123. The third water outlet 2122, the second water inlet 2121 and the fourth water outlet 2123 are sequentially disposed on the inner wall of the second mounting chamber 212 along the axial direction of the second mounting chamber 212. The fourth water outlet 2123 is disposed at the bottom of the second mounting chamber 212. The second water inlet 2121 communicates with the second water outlet 2113. The third water outlet 2122 communicates with the second water outlet passage 215. The fourth water outlet 2123 communicates with the third water outlet passage 216.

The water inlet body 21 is provided with a water-passing chamber 217. The water-passing chamber 217 is located below the first mounting chamber 211 and/or the second mounting chamber 212. The second water outlet 2113 and the second water inlet 2121 communicate with the water-passing chamber 217, respectively. The water inlet body 21 includes a main body 21A and a lower cover 21B. Both the first mounting chamber 211 and the second mounting chamber 212 are disposed on the main body 21A. Both the third water outlet passage 216 and the water-passing chamber 217 are disposed between the main body 21A and the lower cover 21B, so as to facilitate the demoulding process during production. During production, the mounting chambers are first formed on the lower end of the main body 21A and the top end of the lower cover 21B by demolding, and then the main body 21A and the lower cover 21B are bonded to form the third water outlet passage 216 and the water-passing chamber 217.

A middle portion of the operating button 22 is pivotally connected to the water inlet body 21 between the openings of the first mounting chamber 211 and the second mounting chamber 212. In this embodiment, a button cap 25 is mounted on the operating button 22 for easy operation.

The first control assembly 23 includes a first retaining member 231, a first connecting rod 232, and a sealing member 233. The first retaining member 231 is hermetically fitted between the opening of the first mounting chamber 211 and the first water inlet 2111 and blocks the first water outlet 2112. The first retaining member 231 has a first cavity 2311 with an opening facing the second water outlet 2113. The bottom of the first cavity 2311 is provided with a first through hole 2312 extending along the axial direction of the first mounting chamber 211. The side wall of the first through hole 2312 is provided with a fifth water outlet 2313 communicating with the first water outlet 2112. A middle portion of the first connecting rod 232 is provided with a first sealing portion 2321. The first connecting rod 232 is movably inserted in the first through hole 2312. The first sealing portion 2321 is movable to block the fifth water outlet 2313. One end of the first connecting rod 232 is hinged to a first end of the operating button 22. A first return spring 234 is provided between the first end of the operating button 22 and the first retaining member 231.

The sealing member 233 has a second cavity 2331 with an opening facing the first cavity 2311. The other end of the first connecting rod 232 is provided with a flange 2322. The opening of the second cavity 2331 is provided with a limiting member 235. The other end of the first connecting rod 232 is movably inserted through the limiting member 235 and fitted in the second cavity 2331. The flange 2322 is movably fitted with the limiting member 235 to prevent the other end of the first connecting rod 232 from coming out of the second cavity 2331. A second return spring 236 is provided between the bottom of the first cavity 2311 and the sealing member 233. The sealing member 233 is movably, hermetically fitted to the opening of the first cavity 2311 or the second water outlet 2113. In an assembled state, the sealing member 233 is biased by the second return spring 236 to block the second water outlet 2113. Two ends of the first return spring 234 leans against the first retaining member 231 and the operating button 22 to separate the first retaining member 231 and the operating button 22. The first sealing portion 2321 is located on one side of the fifth water outlet 2313 close to the operating button 22.

In order to enhance the airtightness of the product, a first sealing ring 41 is sleeved on the sealing member 233. The first sealing ring 41 is movably, hermetically fitted to the opening of the first cavity 2311 or the second water outlet 2113. A second sealing ring 42 and a third sealing ring 43 are sleeved on the outer periphery of the first sealing portion 2321. The second sealing ring 42 and the third sealing ring 43 are movably, hermetically fitted in the first through hole 2312, and the third sealing ring 43 is movable to block the fifth water outlet 2313. The second sealing ring 42 is located on one side of the fifth water outlet 2313 close to the operating button 22. A first O-ring 51 and a second O-ring 52 are sleeved on the first retaining member 231. The first O-ring 51 and the second O-ring 52 are hermetically fitted between the outer periphery of the first retaining member 231 and the inner wall of the first mounting chamber 211. The first O-ring 51 and the second O-ring 52 are located at two sides of the first water outlet 2112, respectively.

The second control assembly 24 includes a second retaining member 241 and a second connecting rod 242. The second retaining member 241 is hermetically fitted between the opening of the second mounting chamber 212 and the second water inlet 2121 and blocks the third water outlet 2122. The second retaining member 241 has a third cavity 2411 with an opening facing the fourth water outlet 2123. The side wall of the third cavity 2411 is provided with a sixth water outlet 2412 communicating with the third water outlet 2122. The bottom of the third cavity 2411 is provided with a second through hole 2413 extending along the axial direction of the second mounting chamber 212. One end of the second connecting rod 242 is movably, hermetically fitted in the first through hole 2413 and movably leans against a second end of the operating button 22. The other end of the second connecting rod 242 is provided with a second sealing portion 2421. A third return spring 243 is provided between the second sealing portion 2421 and the bottom of the second mounting chamber 212. The second sealing portion 2421 is movably, hermetically fitted to the opening of the third cavity 2411 or the second sealing portion 2421 at the fourth water outlet 2123. In the assembled state, the third return spring 243 presses the second sealing portion 2421 to block the opening of the third cavity 2411. The stroke distance of the second sealing portion 2421 between the opening of the third cavity 2411 and the fourth water outlet 2123 is not greater than the height of the second cavity 2331.

In this embodiment, the fourth water outlet 2123 is provided with a support frame 2124. The second sealing portion 2421 is formed with a fourth cavity 2422 corresponding to the support frame 2124. The third return spring 243 is disposed between the fourth cavity 2422 and the support frame 2124 to ensure the working stability of the third return spring 243. A fourth sealing ring 44 is sleeved on the outer periphery of the second sealing portion 2421. The fourth sealing ring 44 is movably, hermetically fitted to the opening of the third cavity 2411 or the fourth water outlet 2123. A fifth sealing ring 45 is sleeved on the middle of the second connecting rod 242. The fifth sealing ring 45 is movably, hermetically between the second through hole 2413 and the sixth water outlet 2412. A third O-ring 53 and a fourth O-ring 54 are sleeved on the second retaining member 241. The third O-ring 53 and the fourth O-ring 54 are hermetically fitted between the outer periphery of the second retaining member 241 and the inner wall of the second mounting chamber 212. The third O-ring 53 and the fourth O-ring 54 are located at two sides of the third water outlet 2122, respectively.

Referring to FIGS. 3 to 6, the water outlet assembly 3 has a first water outlet chamber 31, a second water outlet chamber 32 and a third water outlet chamber 33 corresponding to the first water outlet passage 214, the second water outlet passage 215, and the third water outlet passage 216, respectively. The first water outlet passage 214 is in communication with the first water outlet chamber 31. The second water outlet passage 215 is in communication with the second water outlet chamber 32. The third water outlet passage 216 is in communication with the third water outlet chamber 33. The first water outlet chamber 31, the second water outlet chamber 32, and the third water outlet chamber 33 have different spray modes.

Referring to FIGS. 3 to 5 and FIG. 7, in the initial state, the second return spring 236 presses the sealing member 233 to block the second water outlet 2113. The two ends of the first return spring 234 lean against the first retaining member 231 and the operating button 22 to separate the two. The first sealing portion 2321 is located on the side of the fifth water outlet 2313 close to the operating button 22. The third return spring 243 presses the second sealing portion 2421 to block the opening of the third cavity 2411. At this time, the water flows through the water inlet passage 213 and the first water inlet 2111 into the first mounting chamber 211, and then flows through the opening of the first cavity 2311, the first through hole 2312, the fifth water outlet 2313, the first water outlet 2112 and the first water outlet passage 214 to enter the first water outlet chamber 31 for the water outlet assembly 3 to achieve a first spray mode, such as an aerated spray mode.

Referring to FIGS. 3 to 5 and FIG. 8, when a force is applied to one end of the button cap 25 close to the first connecting rod 232, the first connecting rod 232 is moved toward the bottom of the first mounting chamber 211, and the other end of the first connecting rod 232 is moved in the second cavity 2331, and the first sealing portion 2321 is moved in the first through hole 2312 to block the fifth water outlet 2313. The sealing member 233 still blocks the second water outlet 2113, and the second sealing portion 2421 still blocks the opening of the third cavity 2411. At this time, the water sequentially flows through the water inlet passage 213 and the first water inlet 2111 into the first mounting chamber 211 and temporarily stays in the first counting chamber 211, and no water enters the water outlet assembly 3, thereby realizing a pause mode.

Referring to FIGS. 3 to 5 and FIG. 9, when a force is applied to the other end of the button cap 25 close to the second connecting rod 242, the second connecting rod 242 is moved toward the bottom of the second mounting chamber 212, and the second sealing portion 2421 is moved to block the fourth water outlet 2123. Since the first end of the operating button 22 is pivotally connected to the first connecting rod 232, the first connecting rod 232 is driven to move in a direction away from the first mounting chamber 211. The first connecting rod 232 drives the sealing member 233 to move toward the first cavity 2311 and to block the opening of the first cavity 2311 through the limiting action of the flange 2322 and the limiting member 235. At this time, the water flows through the water inlet passage 213 and the first water inlet 2111 into the first mounting chamber 211, and then flows through the second water outlet 2112, the water-passing chamber 217, the second water inlet 2121 into the second mounting chamber 212, and then flows through the third cavity 2411, the sixth water outlet 2412, the third water outlet 2122 and the second water outlet passage 215 to enter the second water outlet chamber 32 for the water outlet assembly 3 to realize a second spray mode, such as a strong spray mode. This mode requires pressing the button cap 25 continuously.

Figure 10:
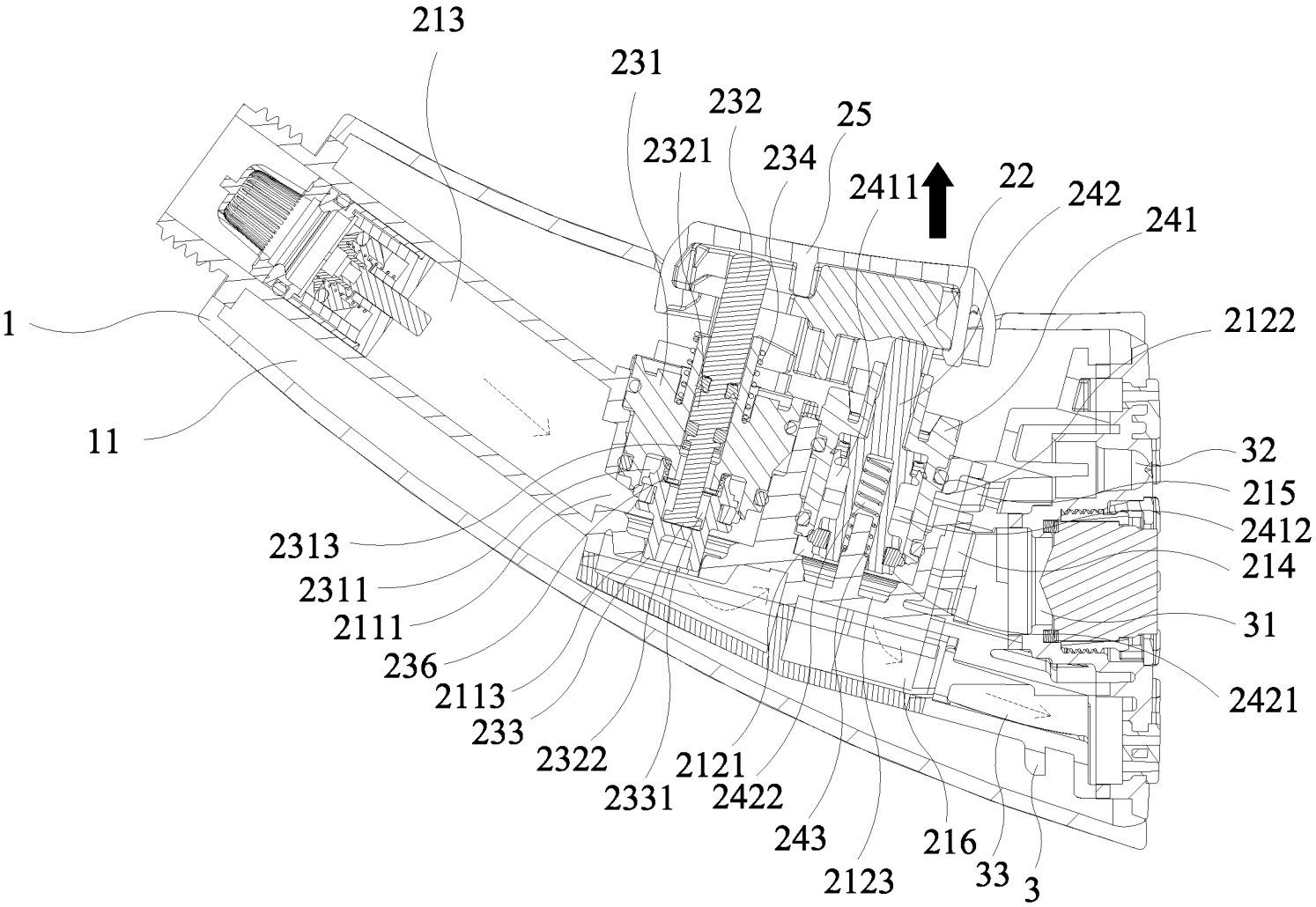
FIG. 10 is a schematic view in accordance with the preferred embodiment of the present invention, showing the water flow in the third spray mode.

Referring to FIG. 10, when the button cap 25 is released in the second spray mode, the third return spring 243 presses the second sealing portion 2421 away from the fourth water outlet 2123 and blocks the opening of the third cavity 2411, so that the second connecting rod 242 is moved in a direction away from the second mounting chamber 212 to push the operating button 22 up. Since the second end of the operating button 22 is pivotally connected to the first connecting rod 232, the first connecting rod 232 is driven to move toward the bottom of the first mounting chamber 211, the flange 2322 is moved in the second cavity 2331, and the second cavity 2331 serves as a space for the first connecting rod 232 to move, so as to prevent the sealing member 233 from being pressed back by the first connecting rod 232 to block the second water outlet 2113 again. At this time, the water flows through the water inlet passage 213 and the first water inlet 2111 into the first mounting chamber 211, and then flows through the second water outlet 2112, the water-passing cavity 217 and the second water inlet 2121 into the second mounting chamber 212, and then flows through the fourth water outlet 2123 and the third water outlet passage 216 to enter the third water outlet chamber 33 for the water outlet assembly 3 to realize a third spray mode, such as a shower spray mode.

With the above structure, the present invention controls the two water outlets of the first mounting chamber 211 through the first control assembly 23, and controls the two water outlets of the second mounting chamber 212 through the second control assembly 24. The first control assembly 23 is configured to realize the pause mode, the first spray mode or the switching of the water passages of the second mounting chamber 212. The second control assembly 24 is configured to realize the switching of the water passages of the second spray mode or the third spray mode. The operating button 22 is configured to link the first control assembly 23 and the second control assembly 24, so as to realize the switching between four different spray modes through a single button. The present invention not only meets the needs of various spray modes, but also has a compact structure and fewer parts to reduce the size and cost of products.

Although particular embodiments of the present invention have been described in detail for purposes of illustration, various modifications and enhancements may be made without departing from the spirit and scope of the present invention. Accordingly, the present invention is not to be limited except as by the appended claims

What is claimed is:

1. A single-button water passage switching structure, comprising a water inlet assembly and a water outlet assembly, a water outlet end of the water inlet assembly being in communication with a water inlet end of the water outlet assembly, the water inlet assembly including a water inlet body, an operating button, a first control assembly, and a second control assembly; a surface of the water inlet body being recessed with a first mounting chamber and a second mounting chamber, extending directions of the first mounting chamber and the second mounting chamber being parallel to each other, the first mounting chamber and the second mounting chamber having openings arranged in a same direction; the first control assembly being fitted in the first mounting chamber, the second control assembly being fitted in the second mounting chamber; a water inlet end of the water inlet body having a water inlet passage, a water outlet end of the water inlet body having a first water outlet passage, a second water outlet passage and a third water outlet passage; the first mounting chamber having a first water inlet, a first water outlet and a second water outlet, the first water outlet, the first water inlet and the second water outlet being sequentially disposed on an inner wall of the first mounting chamber along an axial direction of the first mounting chamber, the second water outlet being disposed at a bottom of the first mounting chamber; the first water inlet communicating with the water inlet passage, the first water outlet communicating with the first water outlet passage; the second mounting chamber having a second water inlet, a third water outlet and a fourth water outlet, the third water outlet, the second water inlet and the fourth water outlet being sequentially disposed on an inner wall of the second mounting chamber along an axial direction of the second mounting chamber, the fourth water outlet being disposed at a bottom of the second mounting chamber; the second water inlet communicating with the second water outlet, the third water outlet communicating with the second water outlet passage, the fourth water outlet communicating with the third water outlet passage; a middle portion of the operating button being pivotally connected to the water inlet body between the openings of the first mounting chamber and the second mounting chamber;

the first control assembly including a first retaining member, a first connecting rod, and a sealing member; the first retaining member being hermetically fitted between the opening of the first mounting chamber and the first water inlet and blocking the first water outlet; the first retaining member having a first cavity with an opening facing the second water outlet, a bottom of the first cavity being provided with a first through hole extending along the axial direction of the first mounting chamber, a side wall of the first through hole being provided with a fifth water outlet communicating with the first water outlet; a middle portion of the first connecting rod being provided with a first sealing portion, the first connecting rod being movably inserted in the first through hole, the first sealing portion being movable to block the fifth water outlet; one end of the first connecting rod being hinged to a first end of the operating button, a first return spring being provided between the first end of the operating button and the first retaining member; the sealing member having a second cavity with an opening facing the first cavity, another end of the first connecting rod being limited and fitted in the second cavity; a second return spring being provided between the bottom of the first cavity and the sealing member, the sealing member being movably, hermetically fitted to the opening of the first cavity or the second water outlet; in an assembled state, the sealing member being biased by the second return spring to block the second water outlet, two ends of the first return spring leaning against the first retaining member and the operating button to separate the first retaining member and the operating button, the first sealing portion being located on one side of the fifth water outlet close to the operating button;

the second control assembly including a second retaining member and a second connecting rod; the second retaining member being hermetically fitted between the opening of the second mounting chamber and the second water inlet and blocking the third water outlet; the second retaining member having a third cavity with an opening facing the fourth water outlet, a side wall of the third cavity being provided with a sixth water outlet communicating with the third water outlet, a bottom of the third cavity being provided with a second through hole extending along the axial direction of the second mounting chamber; one end of the second connecting rod being movably, hermetically fitted in the first through hole and movably leaning against a second end of the operating button, another end of the second connecting rod being provided with a second sealing portion, a third return spring being provided between the second sealing portion and the bottom of the second mounting chamber; the second sealing portion being movably, hermetically fitted to the opening of the third cavity or the second sealing portion at the fourth water outlet; in the assembled state, the third return spring pressing the second sealing portion to block the opening of the third cavity; wherein a stroke distance of the second sealing portion between the opening of the third cavity and the fourth water outlet is not greater than a height of the second cavity.

2. The single-button water passage switching structure as claimed in claim 1, wherein the water inlet body has a water-passing chamber, the water-passing chamber is located below the first mounting chamber and/or the second mounting chamber, and the second water outlet and the second water inlet communicate with the water-passing chamber, respectively.

3. The single-button water passage switching structure as claimed in claim 2, wherein the water inlet body includes a main body and a lower cover, the first mounting chamber and the second mounting chamber are disposed on the main body, and the third water outlet passage and the water-passing chamber are disposed between the main body and the lower cover.

4. The single-button water passage switching structure as claimed in claim 1, wherein a button cap is mounted on the operating button for easy operation.

5. The single-button water passage switching structure as claimed in claim 1, wherein the other end of the first connecting rod is provided with a flange, the opening of the second cavity is provided with a limiting member, the other end of the first connecting rod is movably inserted through the limiting member and fitted in the second cavity, and the flange is movably fitted to the limiting member to prevent the other end of the first connecting rod from coining out of the second cavity.

6. The single-button water passage switching structure as claimed in claim 1, wherein a first sealing ring is sleeved on the sealing member, and the first sealing ring is movably, hermetically fitted to the opening of the first cavity or the second water outlet.

7. The single-button water passage switching structure as claimed in claim 1, wherein a second sealing ring and a third sealing ring are sleeved on an outer periphery of the first sealing portion, the second sealing ring and the third sealing ring are movably, hermetically fitted in the first through hole, the third sealing ring is movable to block the fifth water outlet, and the second sealing ring is located on the side of the fifth water outlet close to the operating button.

8. The single-button water passage switching structure as claimed in claim 1, wherein a first O-ring and a second O-ring are sleeved on the first retaining member, the first O-ring and the second O-ring are hermetically fitted between an outer periphery of the first retaining member and the inner wall of the first mounting chamber, and the first O-ring and the second O-ring are located at two sides of the first water outlet, respectively.

9. The single-button water passage switching structure as claimed in claim 1, wherein the water outlet assembly has a first water outlet chamber, a second water outlet chamber and a third water outlet chamber corresponding to the first water outlet passage, the second water outlet passage, and the third water outlet passage respectively, the first water outlet passage is in communication with the first water outlet chamber, the second water outlet passage is in communication with the second water outlet chamber, the third water outlet passage is in communication with the third water outlet chamber, and the first water outlet chamber, the second water outlet chamber and the third water outlet chamber have different spray modes.

* * * * *